US009601841B2

(12) United States Patent
Strom

(10) Patent No.: US 9,601,841 B2
(45) Date of Patent: Mar. 21, 2017

(54) WIRE TERMINAL ASSEMBLY AND ADAPTER KIT

(71) Applicant: HUBBELL INCORPORATED, Shelton, CT (US)

(72) Inventor: Brent S. Strom, Troy, IL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/881,838

(22) Filed: Oct. 13, 2015

(65) Prior Publication Data

US 2016/0111800 A1 Apr. 21, 2016

Related U.S. Application Data

(60) Provisional application No. 62/064,554, filed on Oct. 16, 2014.

(51) Int. Cl.

| | |
|---|---|
| ***H01R 4/30*** | (2006.01) |
| ***H01R 24/28*** | (2011.01) |
| ***H01R 43/16*** | (2006.01) |
| *H01R 107/00* | (2006.01) |

(52) U.S. Cl.

CPC ..... *H01R 4/307* (2013.01); *H01R 24/28* (2013.01); *H01R 43/16* (2013.01); *H01R 2107/00* (2013.01)

(58) Field of Classification Search

CPC ..... H01R 4/363; H01R 4/36; H01R 4/366; H01R 9/24

USPC ..... 439/811, 812, 709

See application file for complete search history.

(56) References Cited

U.S. PATENT DOCUMENTS

| | | | | |
|---|---|---|---|---|
| 2,906,990 A | | 9/1959 | Cain et al. | |
| 2,907,978 A | * | 10/1959 | Bergan | H01R 4/363 439/793 |
| 2,924,805 A | * | 2/1960 | Lenehan | G01R 11/04 439/167 |
| 3,125,398 A | * | 3/1964 | Wolf | H01R 4/363 439/798 |

(Continued)

FOREIGN PATENT DOCUMENTS

WO WO 2005/088779 A1 9/2005

OTHER PUBLICATIONS

International Search Report and Written Opinion issued in PCT/US2015/55512, dated Jan. 6, 2016.

*Primary Examiner* — Gary Paumen
(74) *Attorney, Agent, or Firm* — Dickinson Wright PLLC

(57) ABSTRACT

An assembly is provided for a connector of an electrical wiring device having a base with a plurality of electrical terminals having a connecting screw. The assembly includes a plurality of terminal connector with a base extending from the first end and having a screw hole for coupling to one of the electrical terminals by a connecting screw. The leg has a screw hole receiving a coupling screw for electrically connecting a wire to the terminal connector and the terminal of the electrical wiring device. A clamping member receives the coupling screw for clamping the wire between the leg and clamping member. A cover encloses the terminal connectors and includes one or more apertures directing a wire through the cover to the terminal connector assembly to clamp the wire in place Access openings are provided in a wall of the cover to access the coupling screws for clamping wires to the terminal connector assembly.

20 Claims, 6 Drawing Sheets

(56) References Cited

U.S. PATENT DOCUMENTS

| | | | | | |
|---|---|---|---|---|---|
| 3,189,865 | A * | 6/1965 | Hawkes, Jr. | H01R 13/502 | 439/106 |
| 3,330,920 | A | 7/1967 | Appleton | | |
| 3,683,414 | A * | 8/1972 | DeAngelo | H01R 4/366 | 24/115 R |
| 3,710,307 | A * | 1/1973 | Cooper, Jr. | H01R 11/26 | 439/523 |
| 4,772,215 | A | 9/1988 | Falk | | |
| 5,782,653 | A * | 7/1998 | Sandor | H01R 13/436 | 439/467 |
| 6,213,818 | B1 * | 4/2001 | Chadbourne | H01R 4/36 | 439/224 |
| 6,347,967 | B1 * | 2/2002 | Tamm | H01R 4/40 | 403/322.1 |
| 8,454,393 | B2 * | 6/2013 | Krawinkel | F16B 41/002 | 439/811 |
| 8,795,006 | B2 * | 8/2014 | Hoffman | H01R 4/363 | 439/811 |
| 8,814,607 | B2 * | 8/2014 | Da Silva | H01R 4/38 | 439/793 |
| 2005/0255757 | A1 * | 11/2005 | Takaya | H01R 4/363 | 439/812 |

* cited by examiner

WIRE TERMINAL ASSEMBLY AND ADAPTER KIT

This application claims the benefit under 35 USC 119(e) of U.S. Provisional Application No. 62/064,554 filed Oct. 16, 2014, which is hereby incorporated by reference in its entirety.

FIELD OF THE INVENTION

The present invention relates generally to a wire terminal connector for an electrical wiring device for enabling multiple wires to be coupled to each terminal connector of the wiring device. The invention is also directed to a wiring adapter kit for modifying or retrofitting an electrical wiring device in the field to allow multiple wires to be coupled to each electrical terminals connector of the wiring device.

BACKGROUND OF THE INVENTION

Electrical connectors, outlets, switches and other wiring devices are commonly used in hazardous and non-hazardous locations. Electrical wiring devices for hazardous locations typically have enclosed housings to protect the internal components. The power supply wires are generally connected to a wire connector formed with the wiring device on a rear side of the base. The electrical wires are connected by a single screw fastener to attach the wire to the wiring device. The housing of the wiring device typically has limited internal space for the wires and the connectors that can make connecting the sires difficult in the field. The wires are often required to be wrapped or twisted around the shaft of the screw before the screw can be tightened. The limited space and construction of the housing presents difficulty in properly wrapping and twisting wire in a manner to ensure secure attachment by the screw.

Electrical connectors for use in hazardous locations are often made so that any exposed electrical components that are brought into mechanical contact with each other are not energized until after the physical contact has been completed. For this purpose, it is desirable to provide a switch, in a sealed chamber, within the connector/receptacle and to arrange the switch so that it can be closed only after the components have been joined. The switches of this form also have limited space for connecting wires and do not permit connecting more than one wire to a single connector.

While connectors for this general purpose have been devised previously, such connectors are generally complicated and expensive to produce. One example of a wiring device for use in hazardous locations is disclosed in U.S. Pat. No. 4,772,215 to Falk. This device has a housing with limited space in the open bottom end of the base to connecting wires. The device includes a single screw for each wire that requires the screw to be wrapped around the screw in the limited space of the base.

In ordinary, non-hazardous locations, it is common to provide a jumper wire from one receptacle to another so that the receptacles are on a single circuit. The receptacles constructed for non-hazardous locations often enable multiple wires to pass through the device or the openings in a mounting surface for wires without difficulty. Non-hazardous location receptacles can have a second set of terminals to connect the receptacle in series or parallel as desired.

Specialty hazardous location receptacles do not have an additional set of terminals for this purpose. The wiring devices, such as receptacles, for use in hazardous locations typically do not have space available for multiple wires and connectors. The hazardous location receptacles require either splitting, to feed downstream devices, the incoming conductors or double wiring the terminals. Splitting the incoming wires can crowd the wiring pull space in the structure or conduit. The receptacles are generally not suitable, or tested and certified for double wiring of the terminals and can increase the problems associated with loosening of the wires during use, which can lead to undesired and dangerous arcing.

While the prior devices are generally suitable for the intended purpose, there is a continuing need in the industry for improved wiring devices.

SUMMARY OF THE INVENTION

The disadvantages of the prior devices are overcome by the present invention. The present invention also provides additional advantages by providing a device where additional wiring can be attached to the connectors of the wiring device.

The present invention is directed to an electrical wiring device assembly where at least one and typically each electrical terminal is capable of coupling to more than one electrical wire. The invention is further directed to an assembly for coupling to an existing electrical wiring device with minimal modification to the electrical wiring device. The invention in one embodiment provides a wiring kit for retrofitting and modifying the contacts and connectors of an electrical wiring device The invention is further directed to a connector assembly for connecting wires to a wiring device. The connector assembly is suitable for modifying or retrofitting an electrical wiring device to enable multiple wires to be connected to a single electrical terminal or connector of the wiring device.

In the embodiments illustrated, the electrical wiring device is an electrical receptacle for connecting to a plug and an electrical power source. The wiring and connector assembly of the invention is suitable for other electrical devices where multiple wires are needed to be connected to a single electrical terminal or connector. The electrical wiring device can be a receptacle, switch or other suitable device.

One feature of the invention is to provide an electrical connector assembly that can be easily attached to an existing electrical connector, electrical receptacle or other electrical wiring device to accommodate multiple wires to a single terminal or electrical contact of an electrical wiring device without the need for additional jumping of wires or connectors. The electrical connector assembly of the invention can be coupled to an electrical wiring device in a factory and distributed as a single unit or assembly. Alternatively, the electrical connector can be coupled to the wiring device in the field or at the work site as needed.

Another aspect of the invention is to provide an electrical connector assembly having a cover member that can fit over the existing electrical connectors and terminals of the electrical device where the cover is provided with access holes for allowing access to the connectors for connecting wires to the electrical connectors. The cover member includes at least one and preferably a plurality of apertures with a dimension to allow a wire to pass through the cover for connecting to the electrical connector. The cover also includes access openings for accessing the coupling screw of the connector to enable connecting of the wire to the connector.

The present invention permits stripped conductors to pass through an aperture in the cover member for coupling with a fastener instead of the common wrapping the conductor around a screw under the screw head, and then tightening the screw while keeping the wrapped wire fully engaged for maximum conductivity. In one embodiment, a second aperture in the cover allows a second wire to pass through the cover to engage the terminal. A single screw can be provided for each phase to couple the two wires to the respective connector.

The invention in one embodiment provides an adapter kit for an electrical wiring device to provide two terminal locations for each phase position or electrical connector of the electrical wiring device thereby making a jumper wire safer. In one embodiment of the invention, the assembly includes a plurality of electrical terminal connectors that can be attached to the existing connectors or terminals of the wiring device. Each connector can have an aperture for receiving a coupling screw and a clamp member coupled to the screw. The clamp member can have a threaded aperture for the screw and can have a width to extend outward from opposite sides of the screw to enable clamping of two wires between the connector and clamp member using a single screw. A cover is positioned over the connectors to enclose each connector. The cover can have a top wall defining a top face with a plurality of apertures for guiding wires through the cover into the space between the connector and the respective clamp member. A side wall of the cover can have an access hole aligned with the screw for accessing the screw with a screw driver or other tool to enable tightening the screw to clamp the wires in place.

The features of the invention in one embodiment are basically attained by providing an assembly for retrofitting an electrical wiring device having a base with a plurality of electrical terminal connectors having a wire connecting screw. The assembly includes a plurality of terminal connectors where each terminal connector includes a leg having a longitudinal dimension defining a first end and a second end and a base extending from the first end substantially perpendicular to the plane of the leg. The base has a screw hole configured for coupling to one of the electrical terminals by a coupling screw. The terminal connector has a screw hole receiving a couping screw configured for electrically connecting a wire to the terminal connector and electrical terminal of the electrical wiring device. In one embodiment of the invention, a cover can be attached to the electrical wiring device to enclose the terminal connectors while allowing access to the terminal connectors for coupling the wires to the connectors.

The features of the invention are also attained by providing an electrical wiring device such as an electrical connector having a base with a plurality of electrical terminals having a threaded aperture. A terminal connector having a leg with a longitudinal dimension defining a first end and a second end with a base extending from the first end is connected to each electrical terminal of the electrical connector. The second end of the leg of the terminal connector has an aperture receiving a coupling screw for connecting a wire to the terminal connector. A clamping member having a threaded aperture is positioned adjacent the leg of the terminal connector and connected to the coupling screw for clamping the electrical wire between the clamping member and the leg of the terminal connector. A cover member is positioned over the electrical connector and clamping member and includes a top wall with a plurality of openings for guiding a wire through the cover to a position between the leg and the clamping member. An access opening is provided in the cover to access the coupling screw and tighten the screws to clamp the wire to the electrical connector.

These and other features of the invention will become apparent from the following detailed description of the invention and the annexed drawings showing various embodiments of the invention.

BRIEF DESCRIPTION OF THE DRAWINGS

The invention will be more readily understood with reference to the embodiments thereof illustrated in the attached drawing figures, which are incorporated herein and in which.

DETAILED DESCRIPTION OF THE INVENTION

The invention is directed to an electrical assembly for coupling a plurality of wires to an electrical wiring device. The invention is also directed to an electrical wiring device having electrical terminals and terminal connectors for coupling one or two electrical wires directly to each of the electrical terminals of the electrical wiring device. The invention is further directed to an electrical assembly for modifying an electrical wiring device to receive a plurality of wires and enabling secure attachment of at least two wires to each of the terminals or connectors of the electrical device. The ability to attach two wires securely to the terminal connectors allows multiple wiring devices to be connected together. The electrical assembly can be in the form of a kit containing the terminal connectors, screws, clamping members and cover member for connecting to the electrical wiring device.

Figure 1:
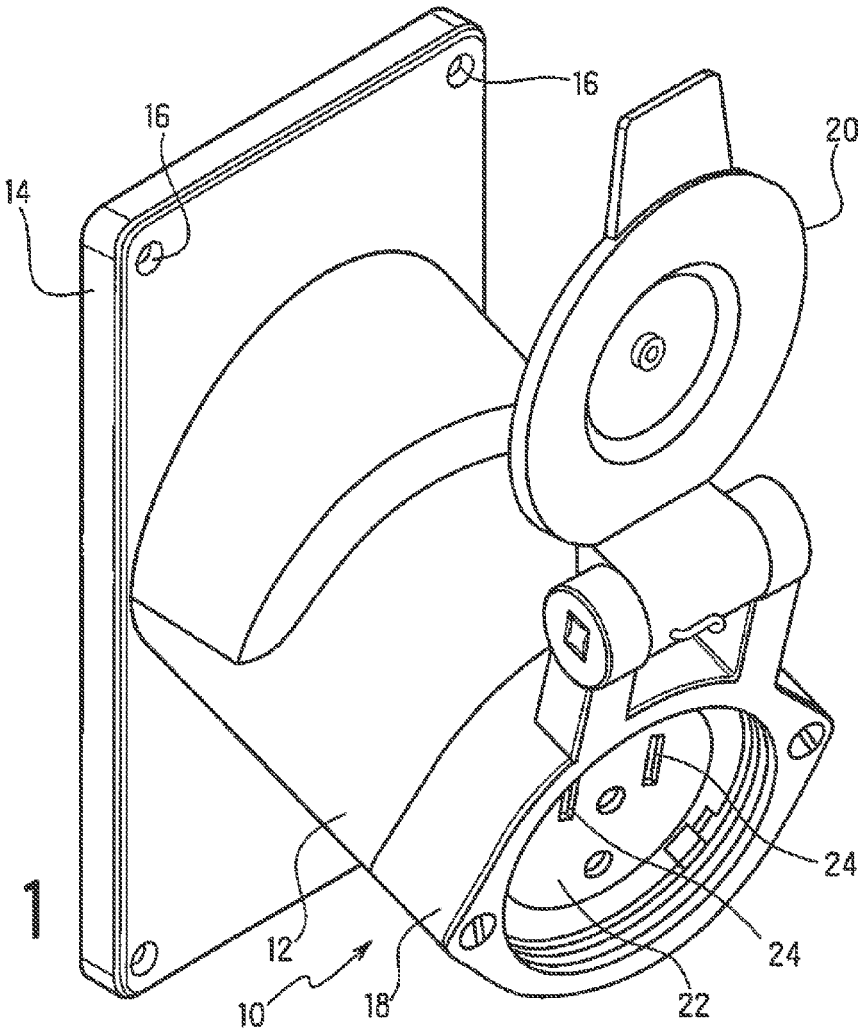
FIG. 1 is a front perspective view of an electrical wiring device in one embodiment of the invention.
Figure 2:
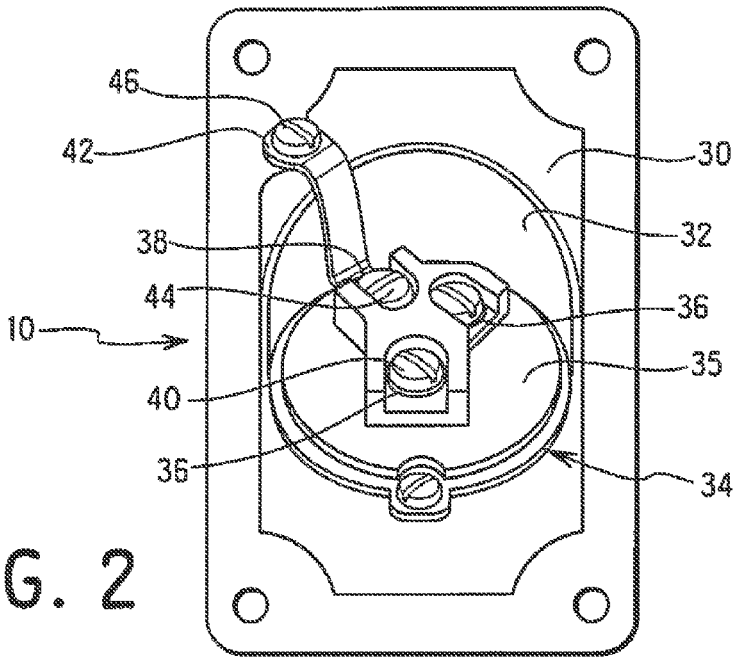
FIG. 2 is a rear view of the electrical wiring device of FIG. 1.

Referring to FIG. 1, one example of an electrical connector is an electrical wiring device indicated generally at 10. In the embodiment shown, the electrical wiring device 10 is an electrical receptacle including a housing having a generally tubular body 12 which is attached to a mounting base 14. IN the embodiment shown, the mounting base is integrally formed with the body of the housing. The housing can be made of a suitable material such as metal or plastic depending on the use and environment. Mounting base 14 typically has a dimensioned to be connected to a box, such as an explosion proof wiring or outlet box, and is provided with a plurality of holes 16 through which fasteners can be passed for mounting the electrical wiring device. The body 12 in the embodiment shown is not perpendicular to the mounting plate 14 but, rather, is inclined at an angle of approximately 45 degrees for the purpose of avoiding collection of any liquid in the electrical portions thereof. One example of an electrical connector is shown in U.S. Pat. No. 4,772,215 to Falk, which is hereby incorporated by reference in its entirety.

At the front end of housing 12 is a mounting ring 18 which supports a cover 20. The cover is hinged so that the cover can pivot between open and closed positions, and is spring loaded so that the cover is urged to a closed position unless held open either manually or by the presence of a plug in the receptacle. In the embodiment shown, a front plate 22 includes slots 24 and openings for receiving the prongs of a plug as known in the art.

The housing 12 of the receptacle 10 has a rear side 30 with a recessed portion 32 receiving an insulated body member 34. The body member 34 has a raised end face 35 accessible through the opening in the housing 12 for supporting electrical terminal contacts 36 and a ground connector 38. The connectors 36 have an internal electrical metal contact with a threaded hole 39 shown in FIG. 4 receiving a coupling screw 40 for coupling the electrical wires to the wiring device. A ground strap 42 is coupled to the ground connector 38 by a screw 44 and has one end attached to the housing 12 by a screw 46. In the embodiment shown, the end face 35 of the body member 34 has a raised portion 48 defining recesses 37 surrounding the coupling screws 40 and 44 so that the screws and the wires connected to the contacts are recessed with respect to the outer face of the body member 34 to separate the wires and prevent the wires from contacting each other or the housing 12. In the embodiment shown, the recesses 37 have an open top end and an open side facing outwardly to receive the wires and allow a tool, such as screw driver, to engage and tighten the screw. In use, the electrical wires are connected to the connectors to supply power to the receptacle and the ground wire is connected to the ground screw.

Figure 3:
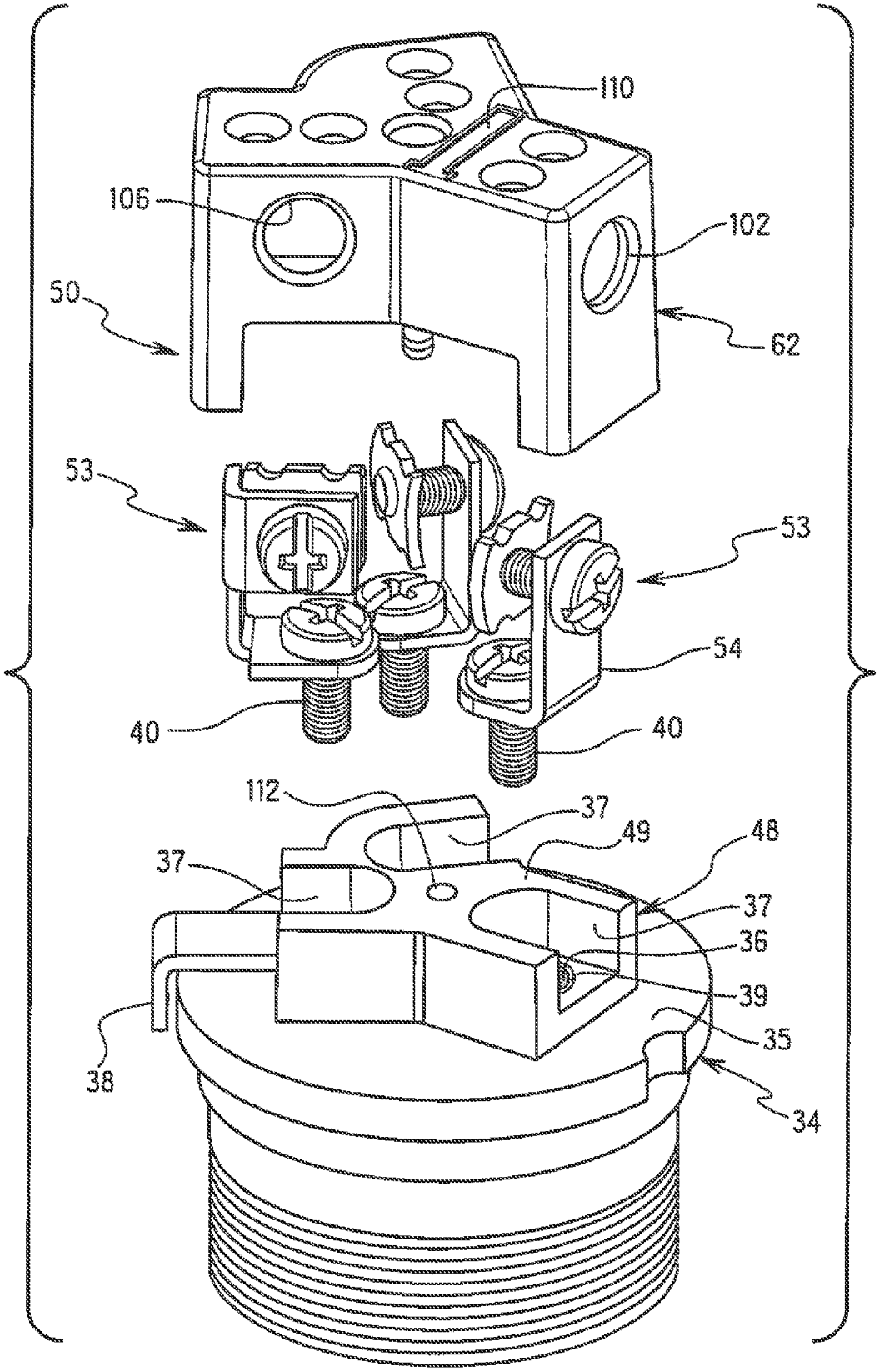
FIG. 3 is an exploded view of the electrical wiring device and terminal connectors of the invention.
Figure 4:
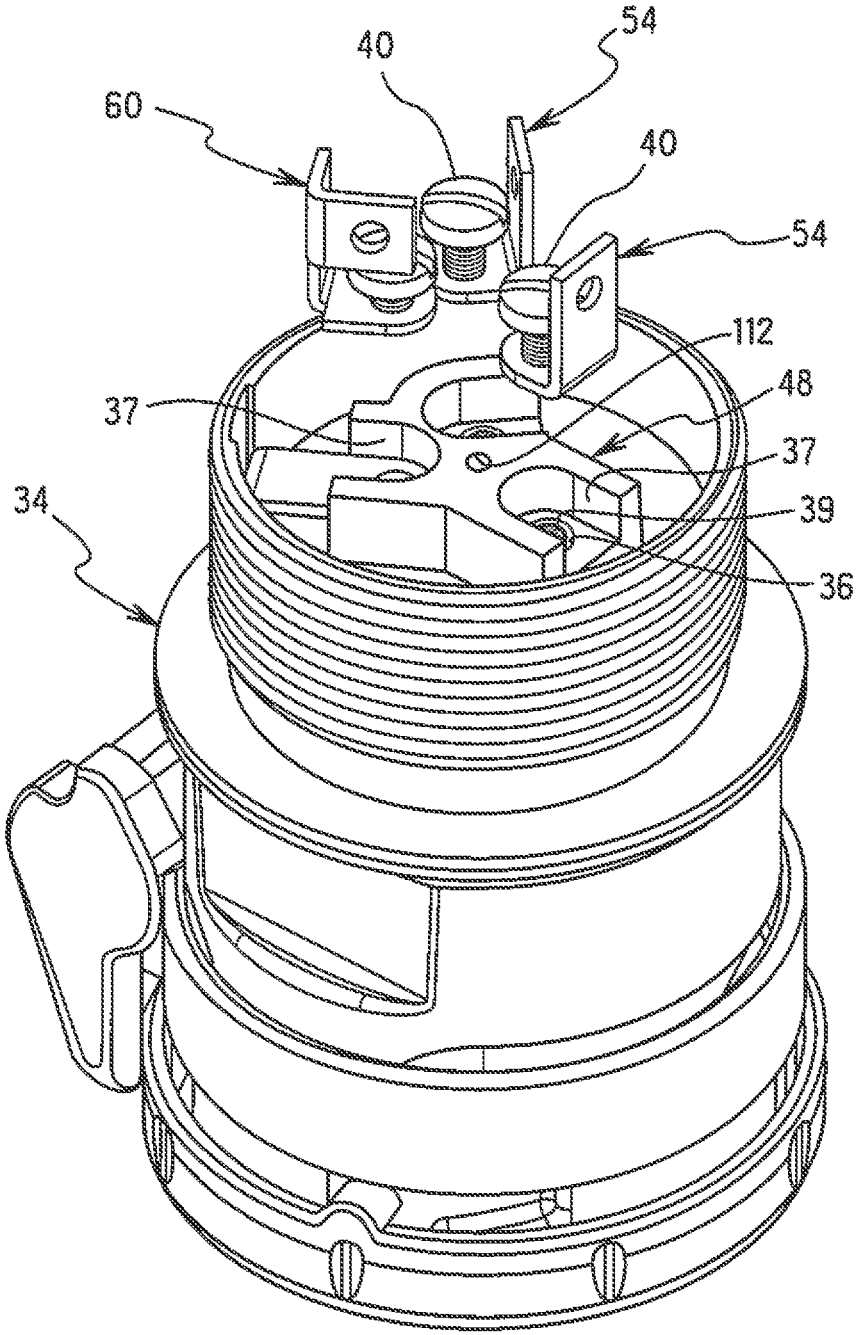
FIG. 4 is an exploded top perspective view of the electrical wiring device and the electrical terminal connectors.
Figure 5:
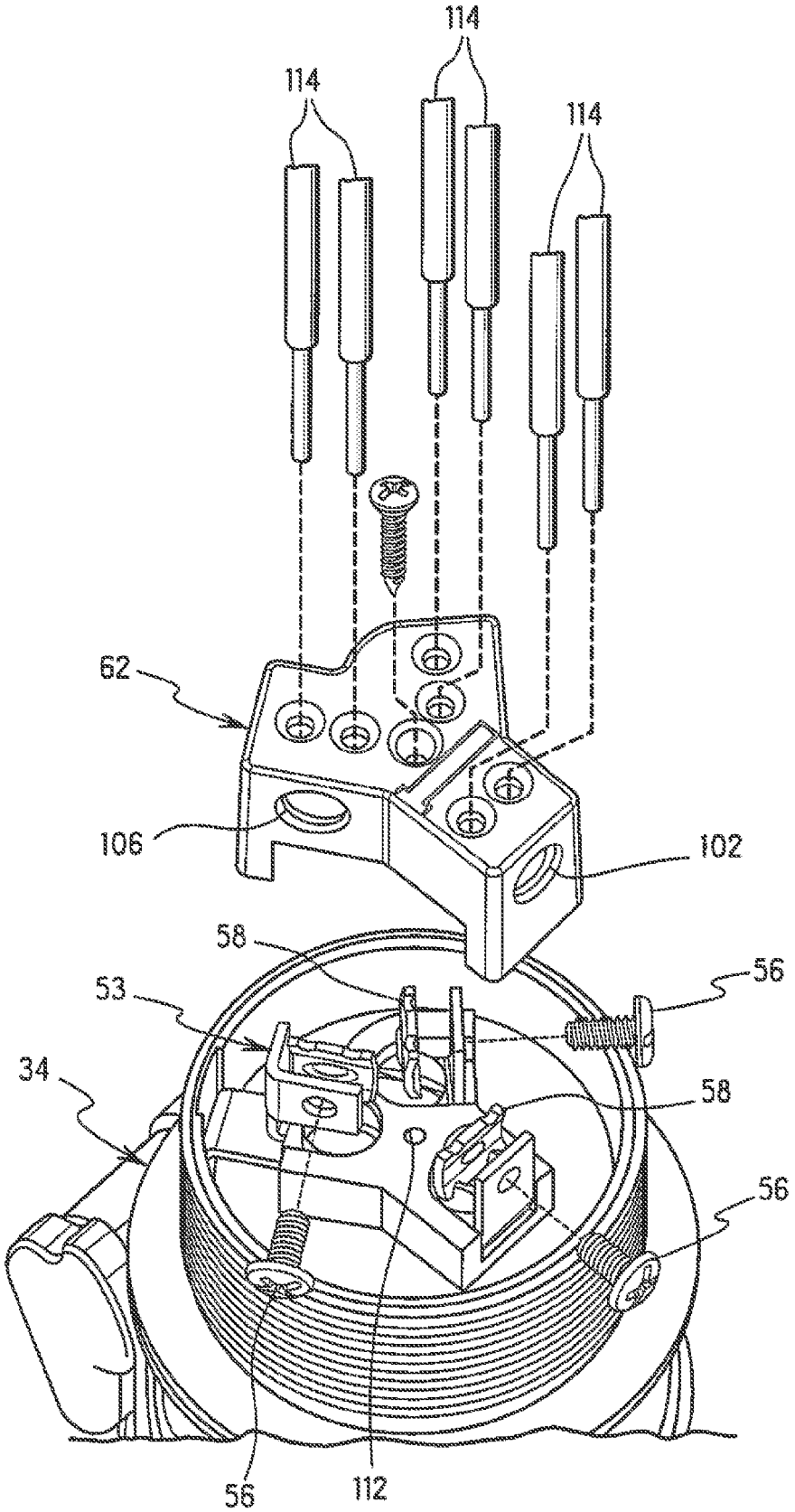
FIG. 5 is an exploded top perspective view of the electrical wiring device showing the cover positioned over the terminal connectors and cover positioned over the terminal connectors.
Figure 6:
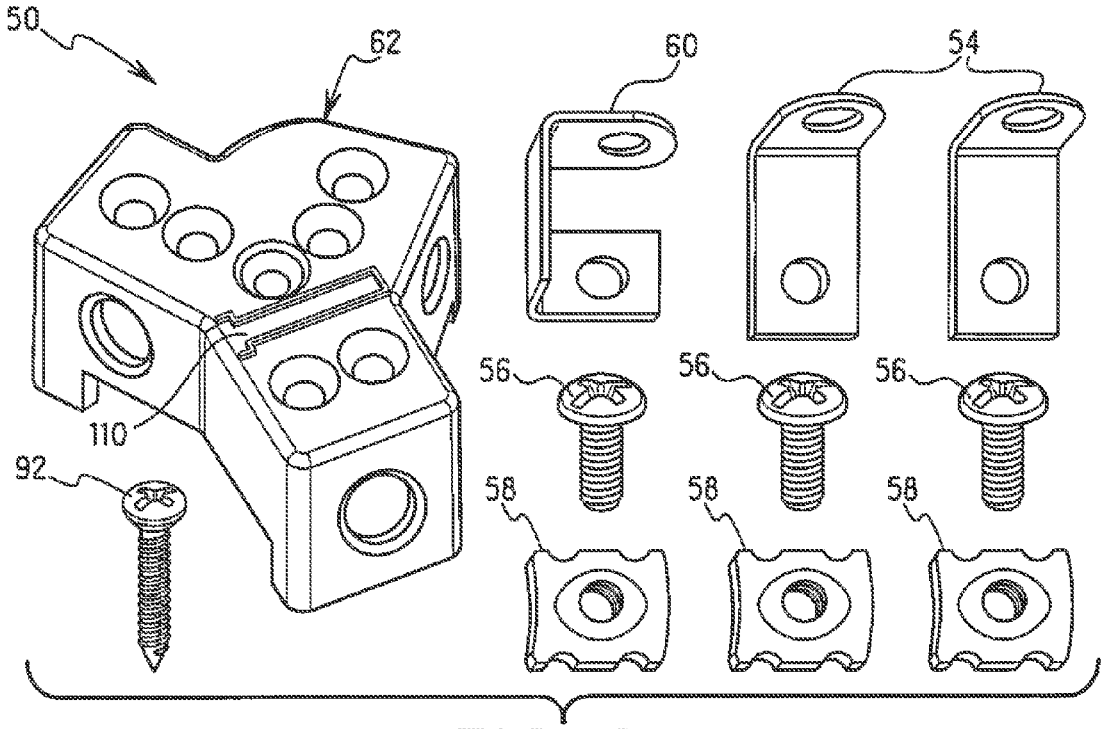
FIG. 6 is a perspective view of a kit and assembly showing the terminal connectors, screws, clamping members and cover member.

In one embodiment, the invention is directed to an assembly 50 for retrofitting, modifying or attaching to an electrical wiring device, such as the receptacle 10. The assembly 50 can be produced and packaged as a kit containing the necessary parts to modify and retrofit the wiring device 10 as shown in FIGS. 3 and 6. In the embodiment shown, the electrical wiring device is a receptacle having a body 34 as shown in FIGS. 3-5. The body 34 is typically mounted within a housing, such as the housing 12, for mounting the receptacle to a support or device in a standard application.

The assembly 50 of the invention includes two or more terminal contact assemblies 53 having terminal connector 54, connections screws 56, clamping members 58 for each terminal contact, ground connector strap 60, and a cover 62. The terminal contacts 54, connecting screws, 56 and clamping members 58 define the terminal assemblies 53 for connecting to the electrical wiring device. As shown in FIG. 6, the components can be assembled as a kit to be produced and sold together for use in retrofitting or modifying the receptacle. In other embodiments, the components are pre-assembled with an electrical wiring device. In one embodiment, the connecting screws 56 are substantially the same as the screws 40 and 46 of the electrical wiring device 10 and can be used interchangeably or as replacement screws for the screws 40.

Figure 8:
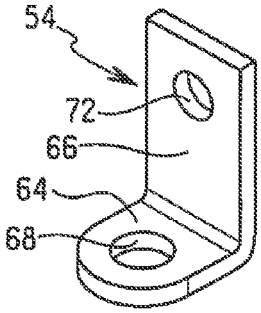
FIG. 8 is a perspective view of the electrical connector in another embodiment.

The terminal contacts 54 as shown in FIGS. 3, 4 and 8 are made of steel, copper, or other electrically conducting material forming terminal blades for connecting the electrical wires to the terminal contact 36 of the electrical wiring device 10. The terminal contacts 54 are made of an electrically conducting flat sheet steel, and formed to have a base portion 64 and a connecting leg 66 extending substantially perpendicular to the base 64. The leg 66 has a first end coupled to the base 64 and a second end spaced from the base. The base 64 has a screw aperture 68 having a dimension to receive a coupling screw 40 as shown in FIG. 3 and FIG. 4. The connecting leg 66 has a screw aperture 72 for receiving a coupling screw 56 for connecting a wire to the terminal connector 54. In the embodiment shown, the leg 66 has a width complementing the width of the recess 37 and a length to extend above the front face of the raised portion 48 as shown in FIG. 5 so that the screw aperture 72 is spaced above the raised portion 48 to avoid interference by the screw 56.

Figure 7:
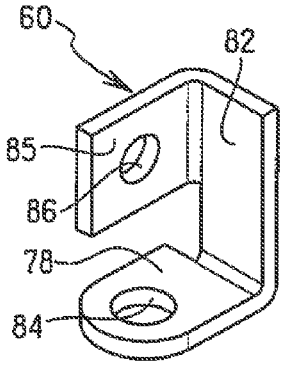
FIG. 7 is a perspective view of the ground connector in one embodiment.
Figure 9:
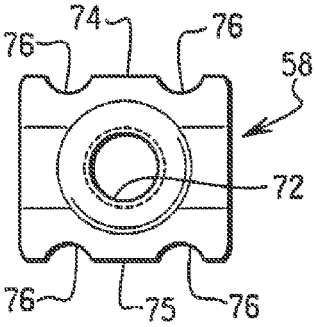
FIG. 9 is a top view of the clamping member.
Figure 10:
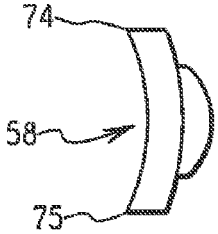
FIG. 10 is an end view of the clamping member.

The clamping members 58 as shown in FIG. 6 and FIG. 7 are made of steel or other electrically conductive metal and stamped to the final shape as shown in FIGS. 9 and 10. In the embodiment shown, the clamping members 58 have a threaded aperture 72 with internal threads for receiving the coupling screws 56 and coupling the clamping members 58 to the respective connecting leg 66. In the embodiment shown, the clamping members 58 have a width corresponding substantially to the width of the leg 66 of the contacts 54. The clamping members 58 are bent or stamped to form a slight concave inner surface and a convex outer surface shown in FIG. 10 so that the longitudinal top and bottom edges 74 and 75 are able to grip an electrical wire by tightening the screw 56. The longitudinal edges 74 and 75 in the embodiment shown have two spaced apart and aligned recesses 76 or notches for engaging, aligning and gripping the wire against the surface of the leg 66.

In the embodiment shown, the clamping members 58 have a threaded aperture 72 to receive the screw where the clamping member 58 is oriented on an inner face of the leg 66 with respect to the center of the body 34 and the head of the screw faces outwardly for accessibility. In alternative embodiments, the leg 66 can have a threaded screw hole and the clamping member 58 can be oriented on the outer face of the leg 66 and clamped between the leg and the head of the screw.

The ground connector 60 as shown in FIG. 7 has a base 78 with a dimension for mating with the contact of the wiring device to overlie the ground contact strap 38. The base 78 has a screw aperture 84 receiving the connecting screw from the ground contact 38 and coupling the ground strap 60 to the ground connector 38. An upwardly extending leg 82 extends substantially perpendicular to the base portion 78 a distance to extend above the raised portion 48 of the insulated body member. The distal end 84 of the leg 82 includes a tab 85 extending perpendicular to the plane of the leg. The tab 85 as shown in FIG. 7 includes a screw aperture 86 for the coupling screw 56 for attaching a ground wire.

The tab 85 and the screw aperture 86 are positioned above the raised portion 48 when assembled as shown in FIG. 5 so that the screw 56 is accessible. As shown, the tab 85 extends inwardly from the leg 82 with respect to the raised portion 48. In the embodiment shown, the legs 66 of the connectors 54 and leg 66 of the ground connector 60 are coupled to the contacts in the recesses 37 of the raised portion 48 so that the legs are positioned at the outer edge of the recesses. The clamping members 58 are positioned within the recesses next to the legs of the connectors so that the wires are received in the respective recess 37 and clamped between the inner surface of the leg and the clamping member 58. In the embodiment shown, the ground connector 60 has the tab 85 extending out of the plane of the leg 82. In another embodiment, the tab 85 can be oriented in a plane substantially parallel to the plane of the leg 82 or can extend from other locations of the leg. The ground connector can also be provided without the tab in a manner similar to the terminal connectors. In a similar manner, the terminal connectors can include a tab for coupling with the wires depending on the structure of the wiring device.

Figure 11:
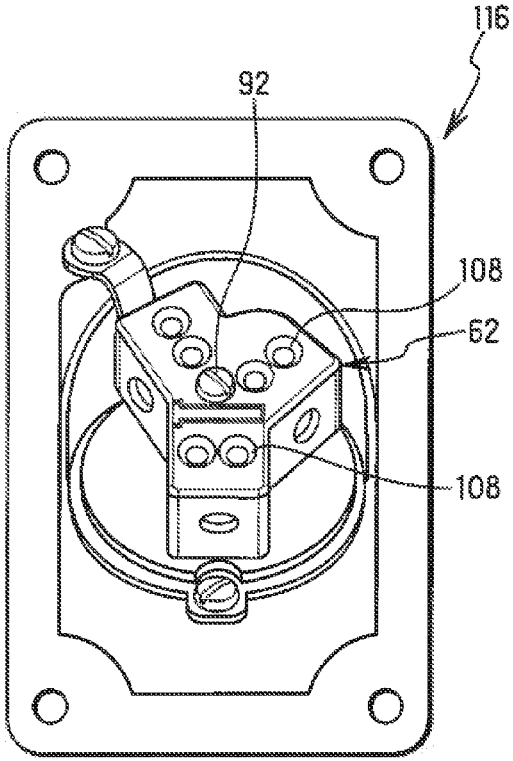
FIG. 11 is a bottom perspective view of the electrical wiring device showing the terminal connector and cover attached to the electrical wiring device.
Figure 12:
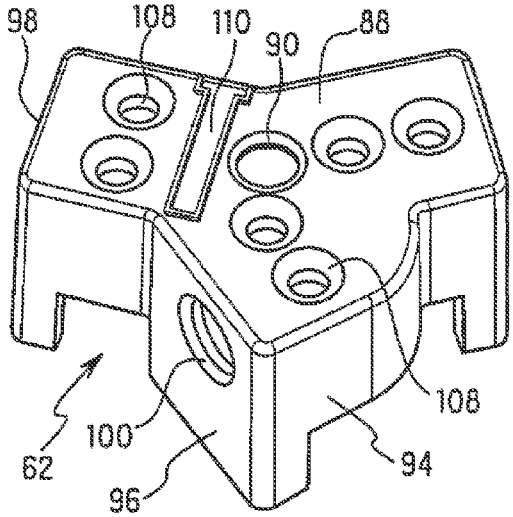
FIG. 12 is a top perspective view of the cover member.
Figure 13:
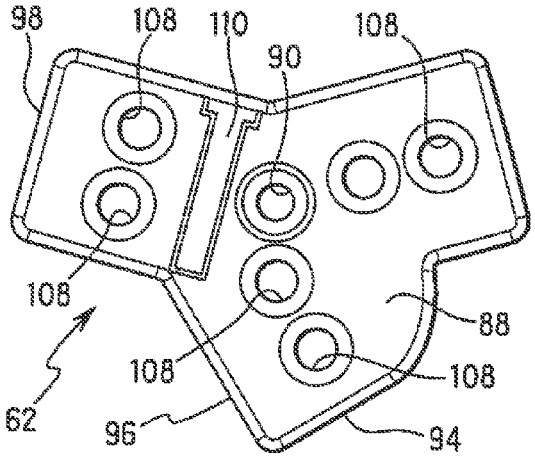
FIG. 13 is a top plan view of the cover member of FIG. 12.
Figure 14:
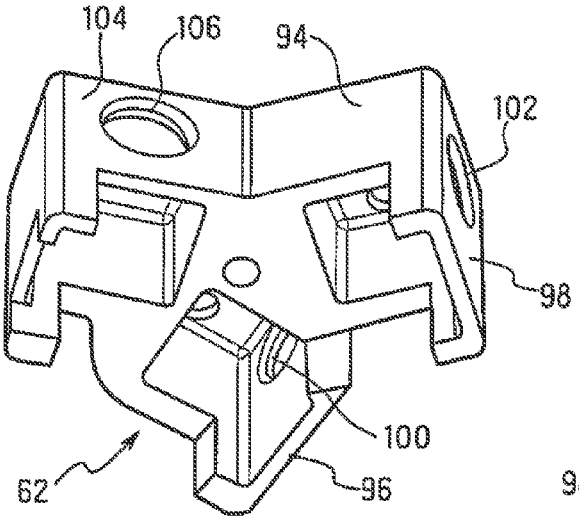
FIG. 14 is a bottom perspective view of the cover member of FIG. 12.
Figure 15:
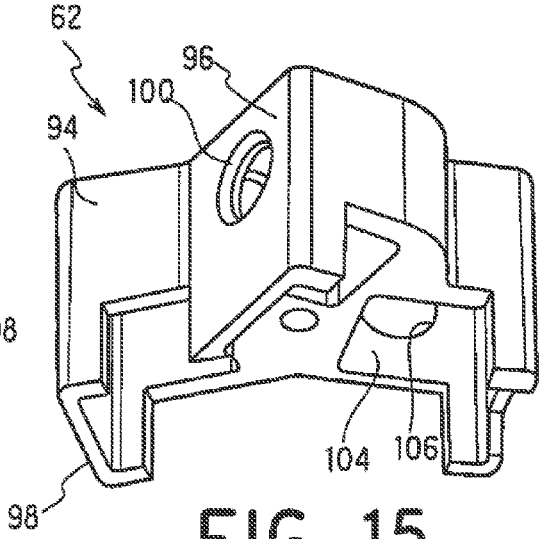
FIG. 15 is another bottom perspective view of the cover member of FIG. 12.
Figure 16:
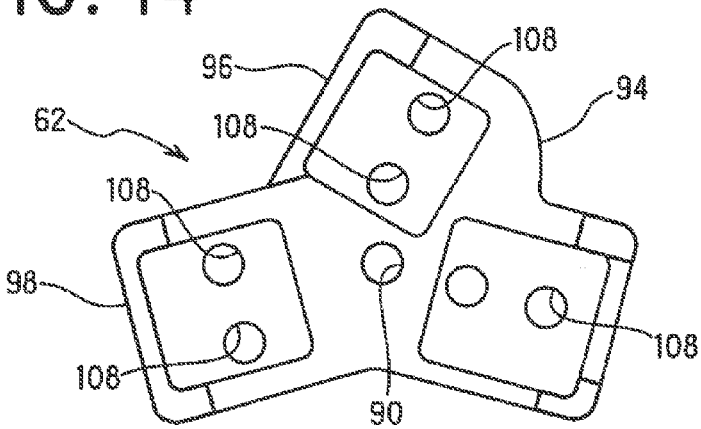
FIG. 16 is bottom view of the cover member of FIG. 12.

The cover 62 is formed from a molded plastic material and has a dimension to enclose the raised portion 48 of the body member 34, the terminal contacts 54 and ground connector strap 60 that are coupled to the electrical wiring device. In the embodiment shown, the cover 62 has a top wall 88 forming a top face having a centrally located aperture 90 with a dimension for receiving a coupling screw 92 for attaching the cover to the body 34. In the embodiment shown, the cover 62 has a substantially V-shape corresponding to the orientation of the electrical contacts and raised portion 48 of the receptacle as shown in FIG. 5 and FIG. 11. In other embodiments, the cover 62 can have a shape and dimension corresponding to the position and number of electrical contacts of the electrical wiring device to enable the cover to enclose the electrical contacts and electrical wires.

The cover 62 has a side wall 94 extending downwardly from the top face 88 with an open bottom end to enclose the electrical contacts when coupled to the body of the electrical receptacle. The side wall 94 includes outwardly facing end wall portions 96 and 98. The end walls 96 and 98 are oriented with respect to the electrical contacts and the terminal connectors 54 when attached to the receptacle. The end walls 96 and 98 have an aperture 100 and 102, respectively, with a dimension for accessing the coupling screws 56 of each leg of the terminal connector 54 by a tool, such as a screw driver. The access apertures 100 and 102 are oriented with respect to the cover 62 to access the coupling screws for clamping the wires to the legs of the connectors.

The cover 62 also has an end wall portion 104 aligned with the ground connector 38 and the ground strap 60. The end wail 104 has an aperture 106 with a dimension to access the coupling screw 56 by a tool such as a screwdriver.

The top wall 88 of the cover 62 has at least one and typically a plurality of wire apertures 108 aligned with the terminal connector 54 and ground strap 60 and the corresponding clamping member 58. In the embodiment shown, two wire apertures 108 are aligned parallel to the edge of the end wall 96 and end wall 98. Two wire apertures 108 are aligned with the side edge of the wall 104 for the ground connector. The wire apertures 108 have a dimension to allow the electrical wires pass through for directing the electrical wire to the terminal connectors. The wire strip gauge 110 is provided on the top wall 88 for measuring the length of the insulation to be removed from the electrical wire prior to connecting the wire to the connectors. In the embodiment shown, the wire apertures 108 have a frustoconical recessed portion surrounding the aperture to guide the wire into the aperture. The wire apertures 108 from guide holes and are preferably aligned with the terminal connectors 54 to guide the wire between the inner face of the leg 66 and the recess 76 of the clamping member 58.

The assembly 50 is used to retrofit and modify an existing electrical wiring device such as the electrical receptacle. The coupling screw 40 and a ground screw 44 are removed from the body member 34. The terminal connectors 54 and the ground connector 60 are attached to the respective electrical contacts of the body member by the coupling screws 40 and 44, respectively as shown in FIG. 4. Alternatively, the terminal connectors 54 and ground connector 60 can be attached by the replacement screws 56. The screws 40 and 44 are securely tightened to fix the connectors to the contacts and provide an electrical connection to the electrical wiring device. The coupling screws 56 are passed through the screw apertures in the terminal connectors 54 and the ground connector strap 60 and threaded into the corresponding clamp member 58 as shown in FIG. 3. In the embodiment shown, the terminal connectors are coupled to the contact with the leg positioned radially outward with respect to the body member 34 and the clamp members 58 are positioned inwardly with respect to the legs. The terminal connectors 54 are coupled to the respective contacts with the head of the coupling screw 56 facing outwardly for access through the access holes in the cover.

A pilot hole 112 can be formed in the top wall of the body member 34 for aligning with the screw hole in the cover 62. The cover 62 is then placed over the terminal connectors 54 and ground connector strap 60 and coupled to the body member 34 by the screw 92 passing through the central aperture 90 and threaded into the pilot hole 112 to secure the cover in place. The cover 62 is positioned over the terminal connector 54 and ground connector strap 60 so that the coupling screws are accessible through the apertures in the walls of the cover 62. Wires 114 are then fed downwardly through the wire apertures 108 in the cover and between the clamp member 58 and the respective terminal connector 54 and ground connector strap 60. A tool, such as a screwdriver, is inserted through the apertures in the wall of the cover to tighten the coupling screws and clamp the wires 114 to the terminal contacts 54 and the ground strap 60. In the embodiment shown, the wire apertures 108 are aligned with the recesses 76 in the clamping member 58 so that the wire is received in the V-shaped recess to grip the wire and resist lateral movement of the wire.

In one embodiment, the connector assemblies and the cover are attached to the electrical wiring device to form an electrical assembly 116 as shown in FIG. 11. The electrical assembly 116 can be formed in the field by the electrician. In other embodiments, the electrical assembly 116 can be produced in the factory and delivered as a pre-assembled, or molded, complete unit to the work site for easy installation.

Although only a few embodiments of the present invention are shown and described, the present invention is not limited to the described embodiments. Instead, it will be appreciated by those skilled in the art that changes may be made to these embodiments without departing from the principles and spirit of the invention. It is particularly noted that those skilled in the art can readily combine the various technical aspects of the various elements of the various exemplary embodiments that have been described above in numerous other ways, all of which are considered to be within the scope of the invention, which is defined by the appended claims and their equivalents.

What is claimed is:

1. An assembly for an electrical wiring device having a body with a plurality of electrical terminal contacts with a threaded hole for receiving a wire connecting screw, said assembly comprising:

a plurality of terminal connectors, each of said terminal connectors having a leg with a longitudinal dimension defining a first end and a second end, a base extending from said first end and configured for coupling to one of the electrical terminal contacts of the electrical wiring device by the wire connecting screw, said leg of said terminal connector having a screw hole receiving a coupling screw configured for electrically connecting a wire to the leg of the terminal connector and the electrical terminal of the electrical wiring device, at least one of said terminal connectors having a flange extending from a side edge of said leg, and where said screw hole is formed in said flange.

2. The assembly of claim 1, wherein each terminal connector assembly further comprises a clamping member having a screw hole for receiving said coupling screw and coupling the electrical wire between said terminal connector and said clamping member.

3. The assembly of claim 2, wherein the screw hole in said clamping member is a threaded screw hole for receiving said coupling screw.

4. The assembly of claim 2, further comprising a cover configured for coupling to the electrical terminal base of the electrical wiring device and configured for enclosing each of the electrical terminals, said cover having a top wall with at least one aperture aligned with a respective terminal connector and oriented to feed the wire through the aperture to said terminal connector and coupling screw.

5. The assembly of claim 4, wherein said cover further comprises a side wall extending from said top wall and configured for surrounding the terminal connectors, said side wall having an access opening oriented to enable access to the coupling screw of each terminal connector.

6. The assembly of claim 5, wherein said top wall has at least two spaced apart apertures, each of said apertures aligned with a respective terminal connector for directing a wire between the respective leg and clamping member.

7. An electrical wiring device comprising:

a body with a plurality of electrical terminal contacts with a threaded aperture configured for receiving a connecting screw, said body having a top face having a plurality of recesses where one of said electrical terminal contacts is positioned in a respective recess;

a one piece terminal connector coupled to each of the electrical terminals, each said terminal connector having a leg with a longitudinal dimension defining a first end and a second end, and a base integrally formed with said leg and extending from the first end, said base having a screw hole configured for receiving said connecting screw for coupling the base to the respective electrical terminal contact by said connecting screw, and said leg having a screw hole receiving a coupling screw configured for electrically connecting a wire to the terminal connector and to the electrical terminal contact of the electrical wiring device, and where said coupling screw and screw hole in said leg are oriented above said top face of said body.

8. The electrical wiring device of claim 7, wherein each terminal connector assembly further comprises a clamping member positioned in a respective recess of said body and having a threaded hole for receiving the coupling screw of the leg, said coupling screw extending through the screw hole in the leg and threaded into the threaded hole for coupling the clamping member to the leg.

9. The electrical wiring device of claim 8, further comprising a cover configured for coupling to the body of the electrical wiring device, said cover having at least one wire aperture aligned with a respective terminal connector assembly and oriented to feed a wire through the aperture to the terminal connector and coupling screw.

10. The electrical wiring device of claim 9, wherein said body has a raised portion and said recesses being formed in said raised portion, and said cover has a side wall extending from a top wall of said cover, and said side wall is configured for enclosing said raised portion of said body and the terminal connectors, and where said side wall has an access opening oriented to access the coupling screw.

11. The electrical wiring device of claim 10, wherein said top wall has at least two apertures spaced apart from each other and aligned with a respective terminal connector for directing at least two wires between the leg and clamping member of the respective terminal connector assembly in a direction substantially parallel to said connecting screw.

12. The electrical wiring device of claim 9, wherein said at least one wire aperture is provided in a top wall of said cover.

13. The electrical wiring device of claim 11, wherein said side wall of said cover has an access opening for accessing said coupling screws, said access opening extending through said side wall of said cover and aligned with said coupling screw.

14. The electrical wiring device of claim 9, wherein said cover has a plurality of wire apertures aligned with each of said terminal connectors, and said cover has a side wall with an access hole aligned with each of said coupling screws.

15. The electrical wiring device of claim 7, wherein at least one of said terminal connectors has a flange extending from a side edge of said leg, and where said screw hole is formed in said flange.

16. A method of retrofitting an electrical wiring device having a body with a raised portion having a top face and a plurality of recesses formed in said top face, a plurality of electrical terminals with a threaded hole configured for receiving a connecting screw where one of said electrical terminals is positioned in a respective recess, said method comprising:

coupling a terminal connector within a respective recess to each of the electrical terminals of the electrical wiring device by a connecting screw, said terminal connector having a leg with a longitudinal dimension defining a first end and second end, and a base integrally formed with and extending from the first end, said base having a screw and coupling the terminal connector to the respective electrical terminal, said leg having a screw hole receiving a coupling screw for electrically connecting a wire to the terminal connector and the electrical terminal of the electrical wiring device, wherein said coupling screw and screw hole are positioned above the top face of the raised portion.

17. The method of claim 16, wherein said terminal connector includes a clamping member having a hole for receiving the coupling screw, said method further comprising positioning a first wire between said clamping member and said leg, and tightening said coupling screw to clamp said wire.

18. The method of claim 17, further comprising positioning a second wire between said clamping member and said leg, and tightening said coupling screw to clamp said first wire and second wire.

19. The method of claim 16, further comprising fitting a cover member over said raised portion of said body and said electrical terminal, said cover member having a top face with guide hole aligned with each of said electrical terminal and a side wall with an opening aligned with the coupling screw, said method comprising inserting the wire through the guide hole to the electrical terminal and tightening said coupling screw through said opening in said side wall.

20. The method of claim 16, wherein at least one of said terminal connectors has a flange extending from a side edge of said leg, and where said screw hole is formed in said flange.

* * * * *